US005992340A

United States Patent [19]

Rombold

[11] Patent Number: 5,992,340

[45] Date of Patent: Nov. 30, 1999

[54] METHOD AND DEVICE FOR LATERALLY ALIGNING THE LATERAL EDGE OF MOVING FLAT MATERIAL WEBS

[75] Inventor: Peter M. Rombold, Remseck, Germany

[73] Assignee: Rombold System GmbH, Germany

[21] Appl. No.: 09/077,282

[22] PCT Filed: Nov. 7, 1996

[86] PCT No.: PCT/EP96/04865

§ 371 Date: May 27, 1998

§ 102(e) Date: May 27, 1998

[87] PCT Pub. No.: WO97/21864

PCT Pub. Date: Jun. 19, 1997

[30] Foreign Application Priority Data

Dec. 12, 1995 [DE] Germany ..... 195 46 208

[51] Int. Cl.[6] ..... D05B 35/10

[52] U.S. Cl. ..... 112/475.03; 112/153

[58] Field of Search ..... 112/318, 475.03, 112/387, 312, 320, 322, 323, 157, 306, 303

[56] References Cited

U.S. PATENT DOCUMENTS 3,970,015 7/1976 Fukuyama ..... 112/153 X 4,616,584 10/1986 Vartoukian et al. ..... 112/153

5,437,238 8/1995 Price et al. ..... 112/153 X 5,497,720 3/1996 Kawasaki ..... 112/153

*Primary Examiner*—Ismael Izaguirre

*Attorney, Agent, or Firm*—Pendorf & Cutliff

[57] ABSTRACT

The invention concerns a method and device for laterally aligning a lateral edge of flat material webs (10) fed to a machining station (16). The lateral position of the edge (26) transversely to the feed direction (14) is detected, so that a position signal is formed and the flat material web (10) is conveyed transversely to the feed direction as a function of this position signal. According to the invention, the transverse conveying, two elongate cylindrical friction rollers (32, 34), whose axes of rotation are aligned transversely to the feed direction (14), are first alternatively urged against the flat material web so that they entrain the flat material web (10) in the sense of their axes of rotation (32', 34') and, as a function of the position signal are moved in a reciprocating manner between two end positions and, secondly are raised off the flat material web, the change of rollers being triggered whenever the end positions are reached.

29 Claims, 4 Drawing Sheets

METHOD AND DEVICE FOR LATERALLY ALIGNING THE LATERAL EDGE OF MOVING FLAT MATERIAL WEBS

BACKGROUND OF THE INVENTION

1. Field of the Invention

The invention is related to a method and a device for laterally aligning a lateral edge of flat material webs fed to a machining station, in which the lateral position of the lateral edge is detected transversely to a feed direction under formation of a position signal and in which the flat material webs are moved transversely to the feed direction as a function of the position signal.

2. Description of the Related Art

Methods of this type are predominantly deployed in automatic sewing machines, where it is important due to high processing speeds that the material edge is automatically guided along a predetermined path. In order to achieve this it is known (EP-B-0 383 045) to use a chain of spherical or crowned roller elements for the transverse transport, which chain can be adjusted in a plane extending approximately transversely to the sewing direction in its longitudinal direction as a function of the position signal and which lies against the material web with a plurality of roller elements having roller axes extending parallel to the aligning direction. The crowned roller elements have a rough or profiled surface structure in order to increase their frictional properties, which can lead to undesirable distortion or damage especially of fine silk or cotton materials.

SUMMARY OF THE INVENTION

Based on this it is the object of the invention to develop a method and a device of the type described above, which ensures a non-damaging yet dependable handling during the lateral alignment of the flat material webs.

The solution according to the invention is based on the idea that two elongated cylindrical friction rollers, the rotational axes of which are aligned transversely to the feed direction, are used to effect the transverse transport, which rollers are alternatingly pressed on the one hand against the flat material web and moved back-and-forth in the direction of their rotational axes between two extreme positions as a function of the position signal, thereby taking along the flat material web, while on the other hand the other roller is lifted off from the flat material web, a change of rollers being triggered whenever the extreme positions are reached. These measures have the advantage that the frictional rollers contact the flat material webs along a greater width, so that no unwanted indentation or distortion of the flat material surface can occur during the transverse transport. A further improvement in this respect is attained when the friction rollers have a surface coating consisting of elastic, preferably rubber-elastic material.

A further improvement in this respect is attained when the transverse transport is stopped during a change of rollers, which can be performed comparatively quickly with suited drive means. This is of importance especially when both friction rollers are momentarily pressed against the flat material web during a change of rollers. The transverse transport after a change of rollers can initially be continued with the substituted roller in the same direction as before the change of rollers. Advantageously, the transverse transport is slowed down by suited drive means when approaching the extreme positions, so that only small accelerating forces occur during the stopping and starting of the transverse transport. The active friction roller is pressed against the flat material web under the action of a preferably adjustable spring force.

An especially advantageous and easily realized embodiment of the invention provides that the two friction rollers are moved, by means of a motor, in opposing directions during the transverse transport and a change of rollers. Both friction rollers are expediently brought into a predetermined starting position, for example a centered position between the two extreme positions, before activation of an aligning process. Further, one of the two friction rollers is brought into contact with the flat material web.

The device for implementing the method according to the invention, which comprises a sensor array for detecting the lateral position of the lateral edge transversely to the feed direction and a transverse transport device which acts upon the flat material web and which is triggered by a position signal taken from an output of the sensor array, has, according to the invention, two cylindrical friction rollers which are adapted to rotate about axes which are aligned transversely to the feed direction, of which rollers one is alternatingly pressed against the flat material web and moved back-and-forth in the direction of the rotational axes between two extreme positions as a function of the position signal, thereby taking along the flat material web, while the other roller is lifted off from the flat material web, a change of rollers being triggered by an extreme position signal whenever one extreme position is reached.

According to a preferred embodiment of the device according to the invention the transverse transport device comprises a change mechanism which reacts to the extreme position signals and which alternatingly moves the friction rollers against and away from the flat material web, as well as two extreme position switches, preferably formed to be proximity switches, for generating the extreme position signals.

The two friction rollers are advantageously adapted to be moved opposingly back-and-forth in the direction of their rotational axes. In order to be able to securely hold the flat material web in the feed direction even during a change of rollers, it is suggested according to a preferred embodiment of the invention that both of the two friction rollers momentarily contact the flat material web at each change of rollers, the transverse transport being stopped at this time. The transverse transport as well as a change of rollers are triggered by means of a micro-computer controlled control device as a function of the measure position signals and extreme position signals.

A particularly simple construction of the device according to the invention provides that the transverse transport device comprises a frame part, two transverse slides which are adapted to be opposingly moved with respect to the frame part by means of a motor, and two changing slides which each carry one of the friction rollers and which each are adapted to be opposingly moved perpendicular to the transverse and feed direction on one of the transverse slides. Alternatively it is possible to position the friction rollers on the transverse slide, when two changing slides which are adapted to be opposingly moved perpendicular to the transverse and feed direction with respect to the frame part, and two transverse slides which each are adapted to be opposingly moved in the transverse direction on one of the changing slides by means of a motor are provided. The transverse slides are advantageously adapted to be driven in opposing directions by means of a common stepper motor and an eccentric transmission. The eccentric transmission can comprise a roller bearing which is formed to be an eccentric disc and which engages a gate of the transverse slide and/or of the changing slide.

The changing slides are expediently adapted to be driven in opposing directions by means of a common, preferably pneumatic torque motor and a further eccentric transmission against the force of a spring force which acts in the direction of the flat material web. By this it is attained that the friction rollers are pressed, under the action of the spring force and the further eccentric transmission being disengaged on the side of the changing slides, against the flat material web which is adapted to moved relative to a base. In order to ensure that both friction rollers momentarily contact the flat material web during a change of rollers the further eccentric transmission on the side of the changing slides has an end-play angle initiating from the contact position of the corresponding friction roller, which ensures that during a change of rollers the friction roller contacting the web under the action of the spring force is lifted off from the web after a time-delay, after the other friction roller already has made contact with the web. The machining station is advantageously formed to be a sewing head of an automatic sewing machine and the flat material web is formed to be a textile web. Other applications of the invention are also feasible, though, as for example in feeding paper webs, plastic webs or sheet metal webs to machining centers.

BRIEF DESCRIPTION OF THE DRAWINGS

In the following the invention is further explained with reference to the accompanying drawing, in which.

DETAILED DESCRIPTION OF THE INVENTION

Figure 1:
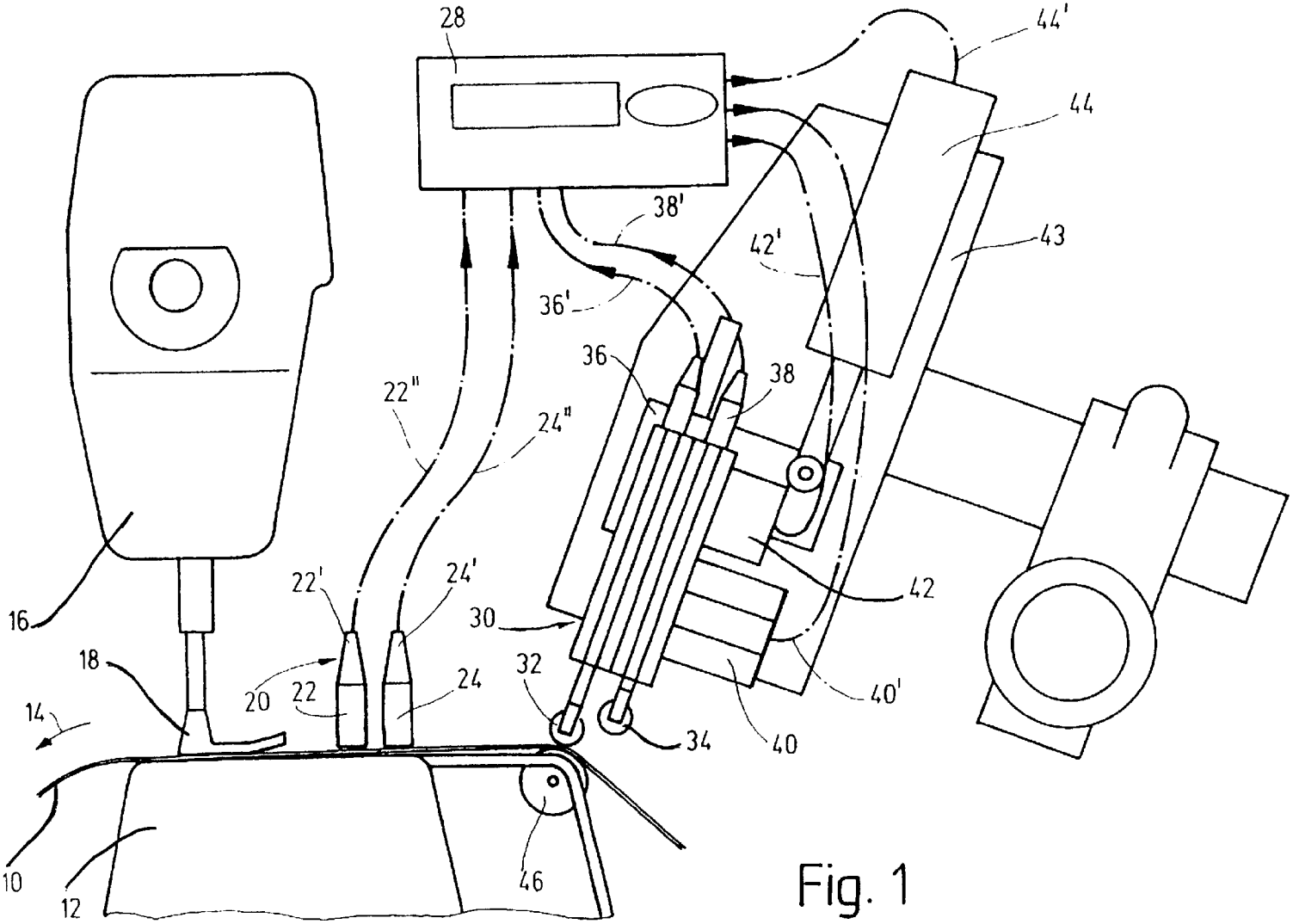
FIG. 1 shows a side view of a detail of an automatic sewing machine having an edge control.

The automatic sewing machine shown in FIG. 1 is used for sewing a textile web 10 near its edge. To this end the textile web is fed to the sewing head 16 in the direction of the arrow 14 on a web support part 12 of the sewing machine. The sewing head is pressed against the web 10 with a contact foot 18. A sensor array is disposed—in the feed direction 14—in front of the sewing head, which sensor array comprises in the embodiment shown two laterally spaced photoelectric barriers 22, 24 disposed in the region of the lateral edge 26 of the passing web 10. The outputs 22', 24' of the photoelectric barriers 22, 24 are connected to a computerized control device 28 by means of signal lines 22", 24".

In front of the sewing head 16 a transverse transport device 30 is additionally provided, which is triggered by the control device 28 for the lateral alignment of the lateral edge 26 of the web in the feed direction 14 as a function of the position signals supplied by the photoelectric barriers 22, 24. To this end the transverse transport device 30 has two cylindrical friction rollers 32, 34 which are freely rotatable about their axes 32', 34' which are aligned transversely to the feed direction 14, of which rollers alternatingly one friction roller 32 contacts the web 10, while the other friction roller 34 is lifted off from the web 10. The two friction rollers 32, 34 are opposingly movable back-and-forth in the direction of the double arrows 32", 34" (FIG. 2), wherein the friction roller in contact with the web 10 is movable back-and-forth, taking along the web 10, between two extreme positions as a function of the position signal emitted by the photoelectric barriers 22, 24. Upon reaching the extreme positions an extreme position signal is generated by the proximity switches 36, 38, which signal is fed to the control device 28 via signal lines 36', 38'.

The transverse movement of the friction rollers 32, 34 is effected by a stepper motor 40 which is actuated via the output line 40' of the control device 28 as a function of the position signals supplied via the signal lines 22", 24".

Figure 2:
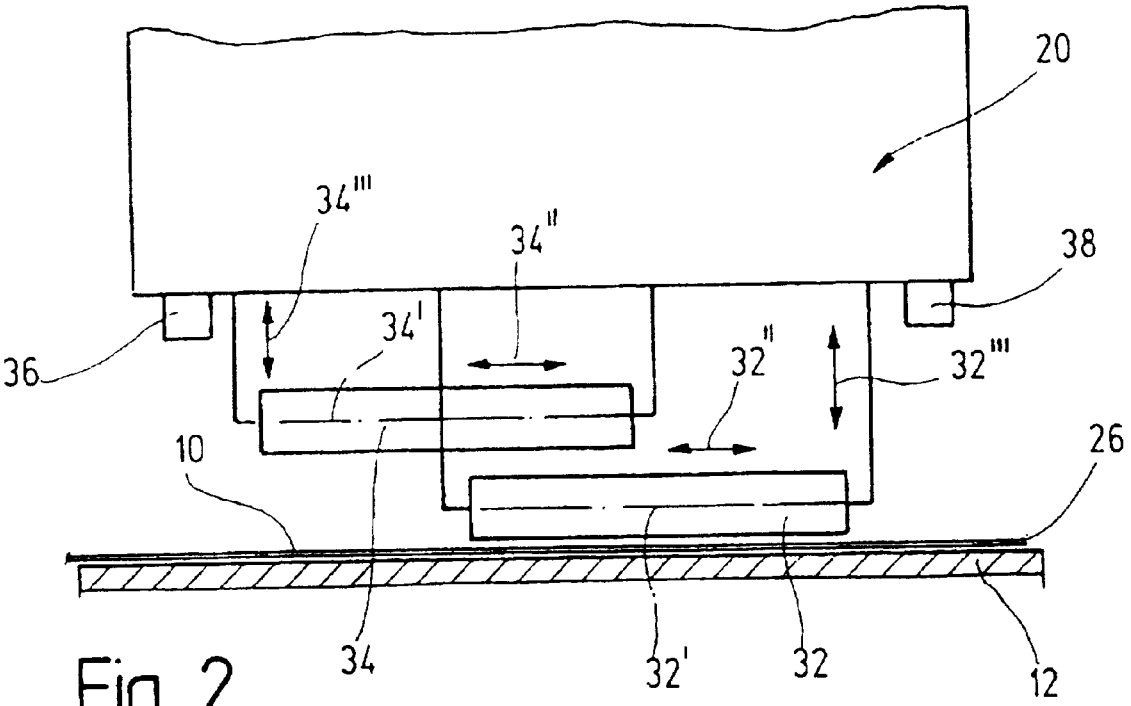
FIG. 2 shows a front view of a detail of the transverse transport device of FIG. 1.

A change of rollers is effected by means of a pneumatic torque motor 42 which is triggered via the output line 42' of the control device 28 when an extreme position signal is detected at one of the signal lines 36', 38'. During this process the friction rollers 32, 34 are moved in opposite directions in the direction of the double arrows 32'", 34'" against and away from the web (FIG. 2). With the linear motor or stroke cylinder 44, which is additionally provided on the frame 43 and which is triggered by way of the output line 44' of the control device 28, the transverse transport device 30 as a whole can be lifted off from or pressed against the thrust roller 46 of the sewing machine. The friction rollers 32, 34 can only be activated when the transverse transport device 30 is in the position in which it is pressed against the thrust roller.

Figure 4:
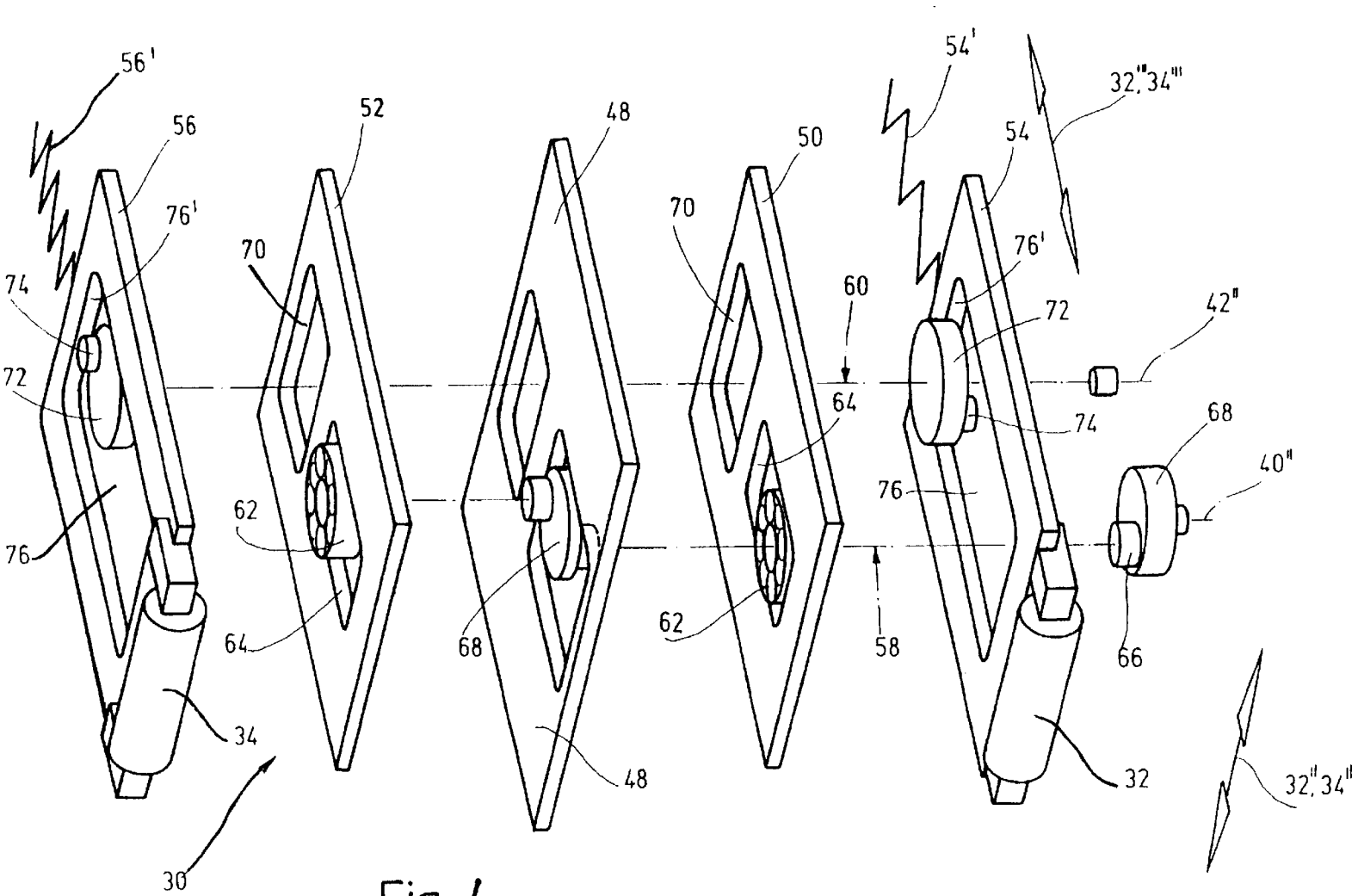
FIG. 4 shows an exploded view of the transverse transport device of FIG. 1.

As can be seen from the schematic exploded view of FIG. 4, the transverse transport device 30 essentially consists of a frame part 48, two transverse slides 50, 52 which are adapted to be opposingly moved with respect to the frame part 48 in the direction of the arrows 32", 34" by means of a motor, and two changing slides 54, 56 which each carry one of the friction rollers 32, 34 and which each are adapted to be opposingly moved on one of the transverse slides 50, 52 in the direction of the arrows 32'", 34'". In this, the transverse slides 50, 52 are moved in the direction of the arrows 32", 34" by the driven shaft 40" of the common stepper motor 40 and the eccentric transmission 58, while the changing slides 54, 56 are moved by the driven shaft 42" and the further eccentric transmission 60 against the force of the compression springs 54', 56' which push in the direction of the web.

The eccentric transmission 58 for the transverse slides 50, 52 comprises two eccentric discs 62 which are formed to be deep groove ball bearings, which engage in the gates 64 of the transverse slides 50, 52 and which are moved in opposing directions by means of the eccentric journals 66 of the drive discs 68 driven by the stepper motor 40.

The further eccentric transmission 60 comprise two drive dics 72 which are concentrically supported in gates 70 of the transverse slides 50, 52, the sliding blocks 74, which protrude in opposing directions, of which drive discs engage in the gate openings 76 of the changing slides 54, 56. The sliding block 74 lies against the frame leg 76' of the gate opening 76 in the position shown in the left part of FIG. 4, and lifts the corresponding changing slide 56 together with the friction roller 34 off from the web 10 against the force of the spring 56', while it is lifted off from the gate leg 76' of the gate 76 in the position shown in the right part of FIG. 4, so that the corresponding changing slide 54 and the friction roller 32 lie against the web 10 under the action of the spring 54'.

When a change of rollers is performed, the sliding block 74 initially rotates in the gate 76 of the right changing slide 54 about a certain dead angle, until it contacts the leg 76' and lifts up the changing slide 54 against the force of the spring 54'. During this time the friction roller 32 remains in contact with the web 10, while the other changing slide 56 with the friction roller 34 is moved, under the action of the spring 56', against the web 10 by the corresponding gate leg 76' during the rotation of the drive disc 72 and lifting off of the sliding block 74.

Figure 5:
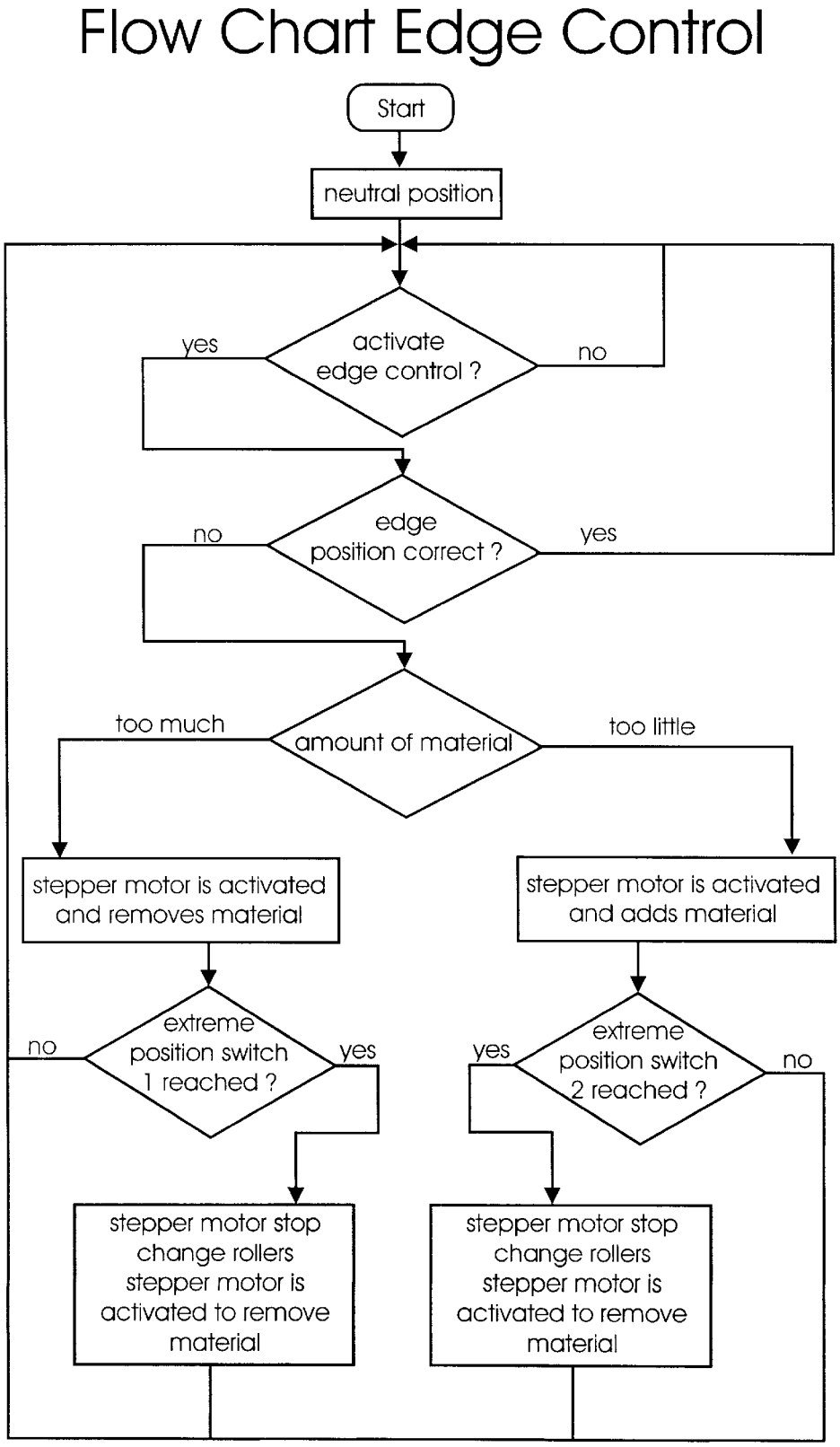
FIG. 5 shows a flow chart of a computer program for edge control.

The program during the edge control is shown in the flow chart of FIG. 5 and executed as follows:

When the program is started the transverse transport device 30 is first brought into a predetermined neutral position, in which the two friction rollers 32, 34 are centered between the two extreme position switches 36, 38 and the friction roller 32 is extended by actuation of the corresponding changing slide 54. The transverse transport device 30 is then brought by actuation of the linear motor 44 into a position in which it is extended against the thrust roller 46.

Figure 3:
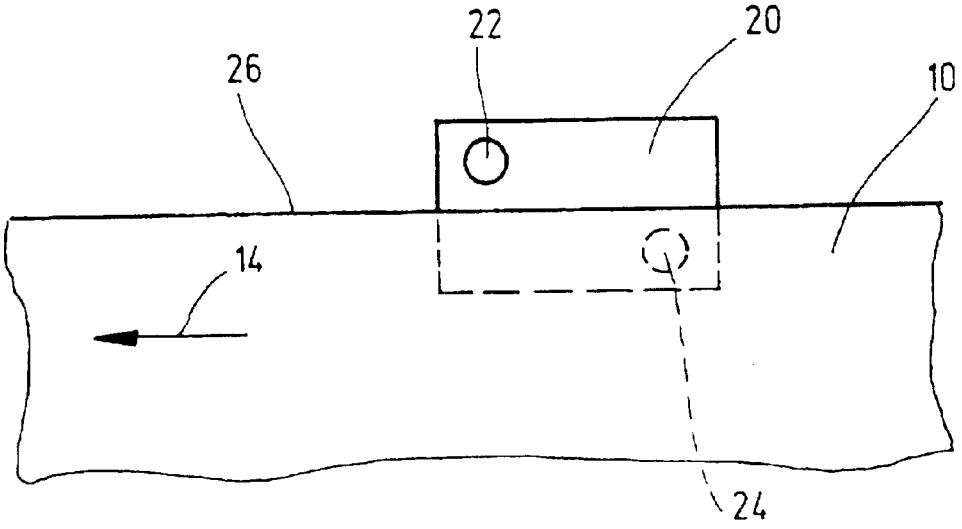
FIG. 3 shows a schematic view of a sensor array for detecting the lateral edge position.

After the activation of the edge control, for example by a web 10 fed to the sensor array 20, the edge position is detected by the photoelectric barriers 22, 24. The branch "yes" is followed when one photoelectric barrier is open and the other is closed (cf. FIG. 3). When this condition is not met anymore (branch "no"), it is determined by way of the photoelectric barriers 22, 24 whether there is too little (both barriers open) or too much (both barriers closed) material present. In the one case material is added and in the other case material is removed by means of the stepper motor 40 and the active friction roller 32, 34, and a new cycle is started via the extreme position switch output, as long as one of the two extreme position switches has not yet been reached.

When one or the other extreme position switch is reached (Branch "yes"), the stepper motor 40 is stopped and the pneumatic torque motor 42 is triggered to effect a change of rollers. After the change of rollers has been performed, the stepper motor 40 is activated in the opposite direction, so that material is added or removed in the previous direction by means of the substituted roller.

The program execution is interrupted when the edge control is deactivated, for instance by an end-of-web signal.

In summary the following is to be stated: The invention is related to a method and a device for laterally aligning a lateral edge of flat material webs 10 fed to a machining station 16. In this the lateral position of the lateral edge 26 is detected transversely to a feed direction 14 under formation of a position signal and the flat material webs 10 are moved transversely to the feed direction 14 as a function of the position signal. According to the invention, two elongated cylindrical friction rollers 32, 34, the rotational axes 32', 34' of which are aligned transversely to the feed direction 14, are used to effect the transverse transport, which rollers are alternatingly pressed on the one hand against the flat material web 10 and moved back-and-forth in the direction of their rotational axes 32', 34' between two extreme positions as a function of the position signal, thereby taking along the flat material web 10, while on the other hand the other roller is lifted off from the flat material web 10, a change of rollers being triggered whenever the extreme positions are reached.

What is claimed is:

1. A method for laterally aligning a lateral edge of flat material webs fed to a machining station, in which the lateral position of the lateral edge is detected transversely to a feed direction under formation of a position signal and in which the flat material webs are moved transversely to the feed direction as a function of the position signal, wherein first and second elongated cylindrical friction rollers, the rotational axes of which are aligned transversely to the feed direction, are used to effect the transverse transport, which rollers are alternatingly on the one hand pressed against the flat material web and moved back-and-forth in the direction of their rotational axes between two extreme positions as a function of the position signal, thereby taking along the flat material web, and on the other hand lifted off the flat material web, an alternation of first and second rollers being triggered whenever the extreme positions are reached.

2. The method of claim 1, wherein the transverse transport is stopped during a change of rollers.

3. The method of claim 1, wherein said first and second rollers are alternated by lifting the pressing roller off from said flat material web and pressing the other roller against said flat material web, and wherein the transverse transport after alternation is initially continued in the same direction as before the alternation of rollers.

4. The method of claim 1, wherein the transverse transport is slowed down when approaching the extreme positions (36, 38).

5. The method of claim 1, wherein both friction rollers (32, 34) are momentarily pressed against the flat material web (10) during a change of rollers.

6. The method of claim 1, wherein the pressing friction roller is pressed against the flat material web under the action of a spring force.

7. The method of claim 1, wherein the two friction rollers (32, 34) are moved in opposing directions during the transverse transport and a change of rollers.

8. The method of claim 1, wherein both friction rollers are brought into a starting position without contacting said flat material web prior to activation of the aligning process, after which one of said two friction rollers is brought into contact with the flat material web.

9. The method as in claim 8, wherein both friction rollers are brought into a centered starting position without contacting said flat material web prior to activation of the aligning process.

10. A device for laterally aligning a lateral edge of flat material webs fed to a machining station, comprising a sensor array for detecting the lateral position of the lateral edge transversely to the feed direction, and comprising a transverse web transport device which acts upon the flat material web and which is triggered by a position signal taken from an output, of the sensor array, wherein the transverse transport device has two cylindrical friction rollers which are adapted to rotate about axes which are aligned transversely to the feed direction, of which rollers one is alternatingly pressed against the flat material web and moved back-and-forth in the direction of the rotational axes between two extreme positions as a function of the position signal, thereby taking along the flat material web, while the other roller is lifted off from the flat material web (10), an alternation of rollers being triggered by an extreme position signal whenever one extreme position is reached.

11. The device of claim 9, wherein the transverse transport device (30) comprises a change mechanism (54, 56) which reacts to the extreme position signals and which alternatingly moves the friction rollers (32, 34) against and away from the flat material web (10).

12. The device of claim 10, wherein the transverse transport device comprises two extreme position switches for generating the extreme position signals.

13. The device of claim 12, wherein said two extreme position switches are proximity switches.

14. The device of claim 10, wherein the two friction rollers (32, 34) are adapted to be moved opposingly back-and-forth in the direction of their rotational axes (32', 34').

15. The device of claim 10, wherein the friction rollers comprise a surface layer made of elastic material.

16. The device of claim 15, wherein said elastic material is rubber-elastic material.

17. The device of claim 10, wherein both of the two friction rollers (32, 34 ) momentarily contact the flat material web (10) at each change of rollers, the transverse transport being stopped at this time.

18. The device of claim 10, wherein the transverse transport device (30) comprises a frame part (48), two transverse slides (50, 52) which are adapted to be opposingly moved with respect to the frame part (48) by means of a motor, and two changing slides (54, 56) which each carry one of the friction rollers (32, 34) and which each are adapted to be opposingly moved perpendicular to the transverse and feed direction on one of the transverse slides (50, 52).

19. The device of claim 18, wherein the transverse slides (50, 52) are adapted to be driven in opposing directions by means of a common stepper motor (40) and an eccentric transmission (58).

20. The device of claim 19, wherein the eccentric transmission (58) comprises a roller bearing which is formed to be an eccentric disc (62) and which engages a gate (64) of the transverse slide (50, 52) and/or of the changing slide (54, 56).

21. The device of claim 18, wherein the changing slides are adapted to be driven in opposing direction by means of a common motor and a further eccentric transmission against the force of a spring force which acts in the direction of the flat material web.

22. The device of claim 21, wherein the friction rollers (32, 34) are adapted to be pressed, under the action of the spring force (54', 56') and the further eccentric transmission (60) being disengaged on the side of the changing slides, against the flat material web (10) which is adapted to moved relative to a base (46).

23. The device of claim 22, wherein the further eccentric transmission (60) on the side of the changing slides has an end-play angle initiating from the contact position of the corresponding friction roller.

24. The device of claim 10, wherein the machining station is formed to be a sewing head (16) of an automatic sewing machine and the flat material web is formed to be a textile web (10).

25. The device of claim 21, wherein said common motor is a pneumatic torque motor.

26. The device of claim 10, wherein the transverse transport device (30) comprises a frame part (48), two changing slides (54, 56) which are adapted to be opposingly moved perpendicular to the transverse and feed direction with respect to the frame part (48), and two transverse slides (50, 52) which each carry one of the friction rollers (32, 34) and which each are adapted to be opposingly moved in the transverse direction on one of the changing slides (54, 56) by means of a motor.

27. The method of claim 1, wherein said machining station is a sewing head.

28. The method of claim 1, wherein said machining station is a sewing head.

29. A method for laterally aligning a lateral edge of flat material webs fed to a machining station, in which the lateral position of the lateral edge is detected transversely to a feed direction under formation of a position signal and in which the flat material webs are moved transversely to the feed direction as a function of the position signal, wherein two elongated cylindrical friction rollers, the rotational axes of which are aligned transversely to the feed direction, are used to effect the transverse transport, wherein one of the two rollers is pressed against the flat material web and moved back-and-forth in the direction of their rotational axes between two extreme positions as a function of the position signal, thereby taking along the flat material web, while the other roller is lifted off from the flat material web, and wherein an alternation of rollers is triggered whenever the extreme positions are reached.

* * * * *